United States Patent [19]

Willenborg

[11] 4,019,219

[45] Apr. 26, 1977

[54] TRASH COMPACTOR APPARATUS

[75] Inventor: Robert A. Willenborg, Dyersville, Iowa

[73] Assignee: The Raymond Lee Organization, Inc., New York, N.Y. ; a part interest

[22] Filed: Oct. 3, 1975

[21] Appl. No.: 619,483

[52] U.S. Cl. ..... 15/339; 15/340; 15/354; 15/414

[51] Int. Cl.[2] ..... A47L 5/12

[58] Field of Search ..... 15/340, 347, 354, 414, 15/339

[56] References Cited

UNITED STATES PATENTS

| | | | |
|---|---|---|---|
| 796,207 | 8/1905 | Harbour | 15/340 X |
| 1,186,079 | 6/1916 | Cooley | 15/414 X |
| 3,460,186 | 8/1969 | Sherrill et al. | 15/340 |
| 3,474,483 | 10/1969 | Heidland | 15/340 X |
| 3,506,998 | 4/1970 | Perry | 15/340 X |
| 3,722,025 | 3/1973 | Gledhill | 15/340 |
| 3,819,069 | 6/1974 | Bauman et al. | 15/340 X |

FOREIGN PATENTS OR APPLICATIONS

| | | | |
|---|---|---|---|
| 502,056 | 1/1956 | Italy | 15/340 |
| 237,532 | 6/1969 | U.S.S.R. | 15/340 |

*Primary Examiner*—Christopher K. Moore
*Attorney, Agent, or Firm*—Howard I. Podell

[57] ABSTRACT

A unit that may be mounted on the flat bed of a truck for sucking up roadside trash which is compressed in a collection bin and transported into the collection body of the truck. The unit includes a telescopic collection tube member which is fitted with pneumatic or hydraulic cylinders to extend sidewards to or away from the truck body and to extend downwards as required to approach trash lying on the roadside. A cutting blade may be mounted adjacent the mouth of the unit for cutting roadside weeds which are then sucked up the collection tube.

1 Claim, 4 Drawing Figures

TRASH COMPACTOR APPARATUS

SUMMARY OF THE INVENTION:

My invention is a unit that may be mounted on the flat bed of a truck for sucking up roadside trash which is compressed in collection bin and transported into the collection body of the truck. The unit includes a telescopic collection tube member which is fitted with pneumatic or hydraulic cylinders to extend sidewards to or away from the truck body and to extend downwards as required to approach trash lying on the roadside. A cutting blade may be mounted adjacent the mouth of the unit for cutting roadside weeds which are then sucked up the collection tube.

BRIEF DESCRIPTION OF THE DRAWINGS:

The objects and features of the invention may be understood with reference to the following detailed description of an illustrative embodiment of the invention, taken together with the accompanying drawings in which.

Figure 1:
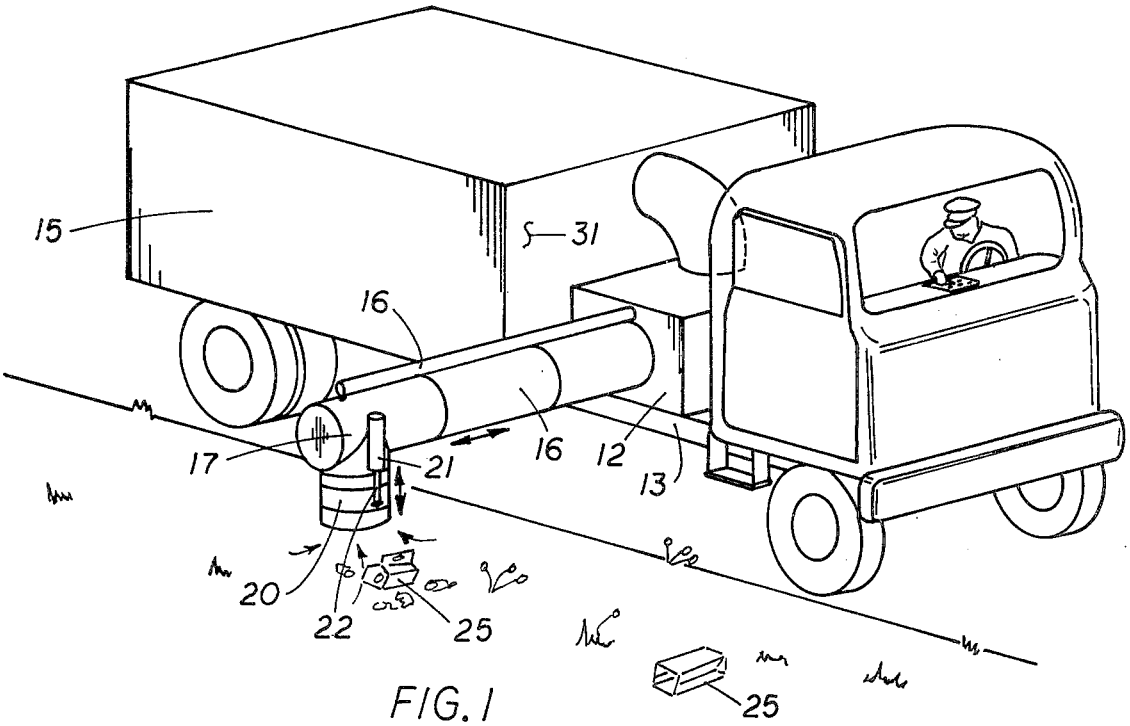
FIG. 1 is a perspective view of the invention in use.
Figure 2:
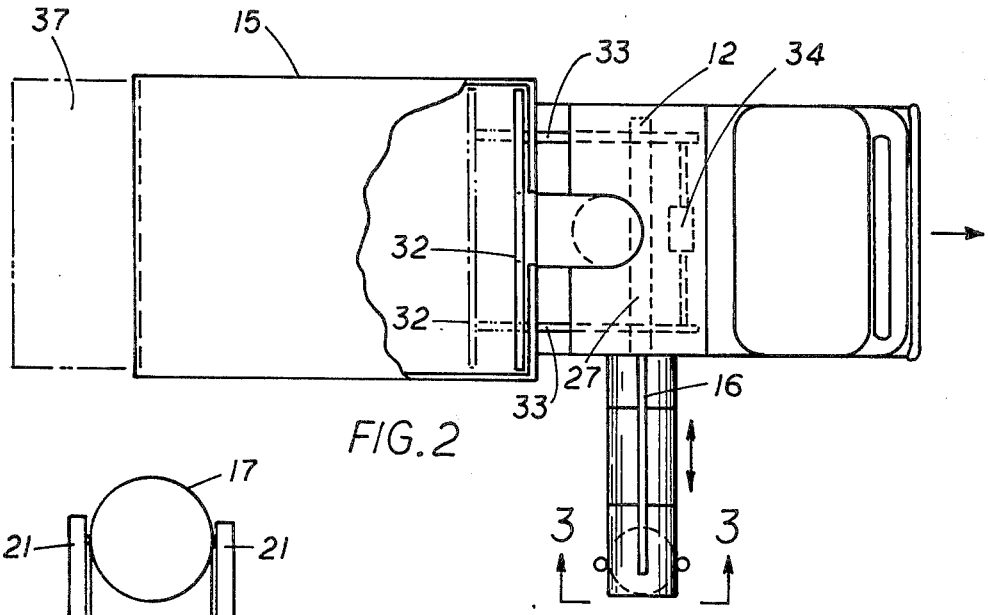
FIG. 2 is a plan view of the invention installed.
Figure 3:
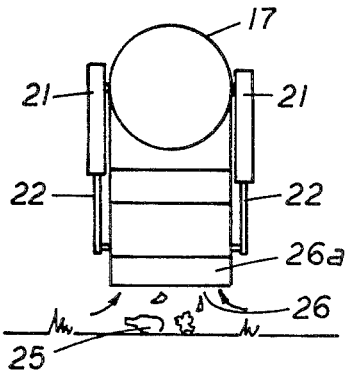
FIG. 3 is a side view of the collection tube, taken along 3—3 of FIG. 2.
Figure 4:
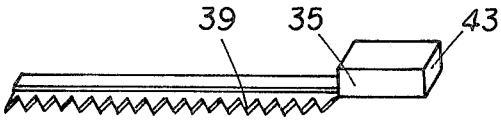
FIG. 4 is a perspective view of the attachable cutter bar.

DESCRIPTION OF THE PREFERRED EMBODIMENT:

Turning now descriptively to the drawings, in which similar reference characters denote similar elements throughout the several views, FIG. 1–2 illustrate a truck 11 equipped with the invention. A suction fan is located in a housing 12 mounted on the truck bed 13 behind the driver's cab 14 and in front of the truck container 15. A telescopic inlet tube 16 extends laterally from the fan housing 12 being supported at its far end 17 by the piston 16 of a hydraulic cylinder 27 mounted in the fan housing 12. A pick-up telescopic tube 20 extends downwards from the far end 17 of the inlet tube 16 with the tube 20 supported by the pistons 22 of hydraulic cylinders 21 mounted at the far end 17 of the inlet tube. Operation of the hydraulic cylinders cause their respective pistons to either retract, or to extend the inlet tube and the pick-up tube to a position for sucking up trash and litter 25 along the side of the road lane in which the truck is driven. A funnel-shaped mouth may be mounted across the opening 26 of the pick-up tube, as desired.

An outlet tube from the fan housing 12 extends through the top of the front wall 31 of the truck container 15 leading to a compartment in which the litter expelled into the container 15 may be compressed by a vertical plate 32 mounted on a pair of horizontal slide arms 33 which are actuated by an electrical motor drive 34 in the housing 12 to compress intially collected litter. The compressed litter is conveyed by a mechanism (not shown) towards the rear of the truck container in which an emptying door 37 is located.

A rig may be added to the outermost telescopic tube member 26A of the pick-up in the form of a grass-cutter blade unit 35. Blade unit 35 may be a fixed blade 38 formed with sharpened teeth 39 or alternatively blade unit 35 may incorporate a reciprocating toothed blade operated by a motor in housing 43 attached to the blade unit. The clippings cut by blade unit 35 are sucked up the inlet tube to leave the roadside completely litter-free in use.

Since obvious changes may be made in the specific embodiments of the invention described herein, such modifications being within the spirit and scope of the invention claimed, it is indicated that all matter contained herein is intended as illustrative and not as limiting in scope.

Having thus described the invention, what I claim as new and desire to secure the Letters Patent of the United States is:

1. Apparatus mountable on the flat bed of a truck for picking up roadside debris, comprising, a housing for containment of debris, a suction fan unit externally mounted to said housing with the outlet tube of the suction fan unit led into the housing, an inlet tube fitted to said suction fan unit which extends, in the mounted position of the unit, in a generally horizontal plane from a lateral side of the suction fan unit, a pick-up tube fitted to the external end of said inlet tube which extends vertically downwards from said unit in said mounted position, said inlet tube and said pick-up tube each being formed of telescopic members and each fitted with an individually associated fluid-operated cylinder and piston, the axis of which extends parallel to the axis of the tube to which it is mounted, so that each tube may be independently extended or retracted along its axis by the associated cylinder and piston unit, said housing fitted with means to compact the debris blown into the housing by the suction fan unit.

* * * * *